United States Patent [19]

Procacino

[11] Patent Number: 4,570,822

[45] Date of Patent: Feb. 18, 1986

[54] COMPUTER OPERATED FILLING SYSTEM

[75] Inventor: Robert A. Procacino, Haddon Heights, N.J.

[73] Assignee: Cozzoli Machine Co., Plainfield, N.J.

[21] Appl. No.: 549,081

[22] Filed: Nov. 7, 1983

Related U.S. Application Data

[63] Continuation of Ser. No. 275,094, Jun. 19, 1981, abandoned.

[51] Int. Cl.[4] ..... B67D 5/14

[52] U.S. Cl. ..... 222/14; 222/52; 222/482; 137/487.5; 137/624.11; 141/192; 251/7; 364/510

[58] Field of Search ..... 222/14, 15, 16, 20, 222/52, 55, 59, 482; 141/243, 244, 192; 364/510, 479; 340/626; 137/487.5, 624.11; 251/7

[56] References Cited

U.S. PATENT DOCUMENTS

| | | | |
|---|---|---|---|
| 1,227,628 | 5/1917 | Kiefer | 141/244 |
| 3,934,471 | 1/1976 | White et al. | 364/510 X |
| 4,052,003 | 10/1977 | Steffen | 239/71 |

FOREIGN PATENT DOCUMENTS

| | | | |
|---|---|---|---|
| 468095 | 5/1975 | U.S.S.R. | 222/59 |

*Primary Examiner*—Joseph J. Rolla
*Assistant Examiner*—Frederick R. Handren
*Attorney, Agent, or Firm*—Kirschstein, Kirschstein, Ottinger & Israel

[57] ABSTRACT

A liquid filling machine has a plurality of discharge nozzles for simultaneously filling a plurality of containers. Each nozzle is connected to a manifold and has a restriction. A discreet pressure sensor is connected to each nozzle upstream from its restriction, and a solenoid valve is provided for each nozzle. A programmable device is connected to each pressure sensor and each valve for calculating a number indicative of fill time and closing each valve when the number is reached.

10 Claims, 4 Drawing Figures

COMPUTER OPERATED FILLING SYSTEM

This is a continuation, of application Ser. No. 275,094, filed June 19, 1981, now abandoned.

BACKGROUND

Historically, liquids such as food, pharmaceuticals, and the like have been filled into containers by means of multiple piston positive displacement pumps. Such systems have various drawbacks. For example, the pumps and pistons have to be mechanically adjusted, are subject to wear, and require substantial time for disassembly to facilitate periodic sterilization and cleaning.

Recently filling machines have emerged with solid state electronics and programmable devices to control the time during which a valve is open which in turn determines fill volume. Those systems are also objectionable in that they require potentially dangerous pressure vessels for containing the supply liquid, require expensive pressure sensing circuits so that the programmable means must take into consideration the pressure in the vessel and/or the speed of a pump. Thus, the last-mentioned systems depend on or seek to maintain constant pressure within the pressure vessel.

The present invention overcomes disadvantages of the prior art by providing a system having the following design criteria:

(a) elimination of all moving parts in contact with the liquid being fed, (b) elimination of pressure vessels and pressure control systems, (c) maintain accuracy of fill with pressure variations of 25 percent or more, (d) facilitate cleaning and sterilization with the use of throw-away components.

SUMMARY OF THE INVENTION

The present invention is directed to a liquid filling machine. A non-pressurized holding tank is connected to a distribution manifold therebelow so that liquid may flow from the tank to the manifold by gravity. A plurality of discharge nozzles are provided for simultaneously filling a plurality of containers. Each nozzle is connected to the manifold by a discrete flexible hose. Each nozzle has a restriction. A discrete means for sensing pressure is connected to each nozzle upstream from the nozzle restriction for generating a pressure signal.

A discrete valve is provided for controlling flow from each flexible hose. The programmable means is separately connected to each pressure sensing means and to each valve for calculating a number indicative of fill time and for closing each valve when the number is reached.

It is an object of the present invention to provide a computer operated filling system which eliminates moving parts in contact with the liquid being fed, eliminates pressure vessels and pressure control systems, maintains accuracy of fill of containers with wide variations in head pressure, and facilitates cleaning and sterilization with the use of throw-away components.

It is another object of the present invention to provide a liquid filling machine wherein a programmable means requires a minimum of input signals, with one of the signals being a pressure signal generated upstream from a restriction in a nozzle which is connected to a non-pressurized holding tank by flow lines which in part include flexible throw-away hoses.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
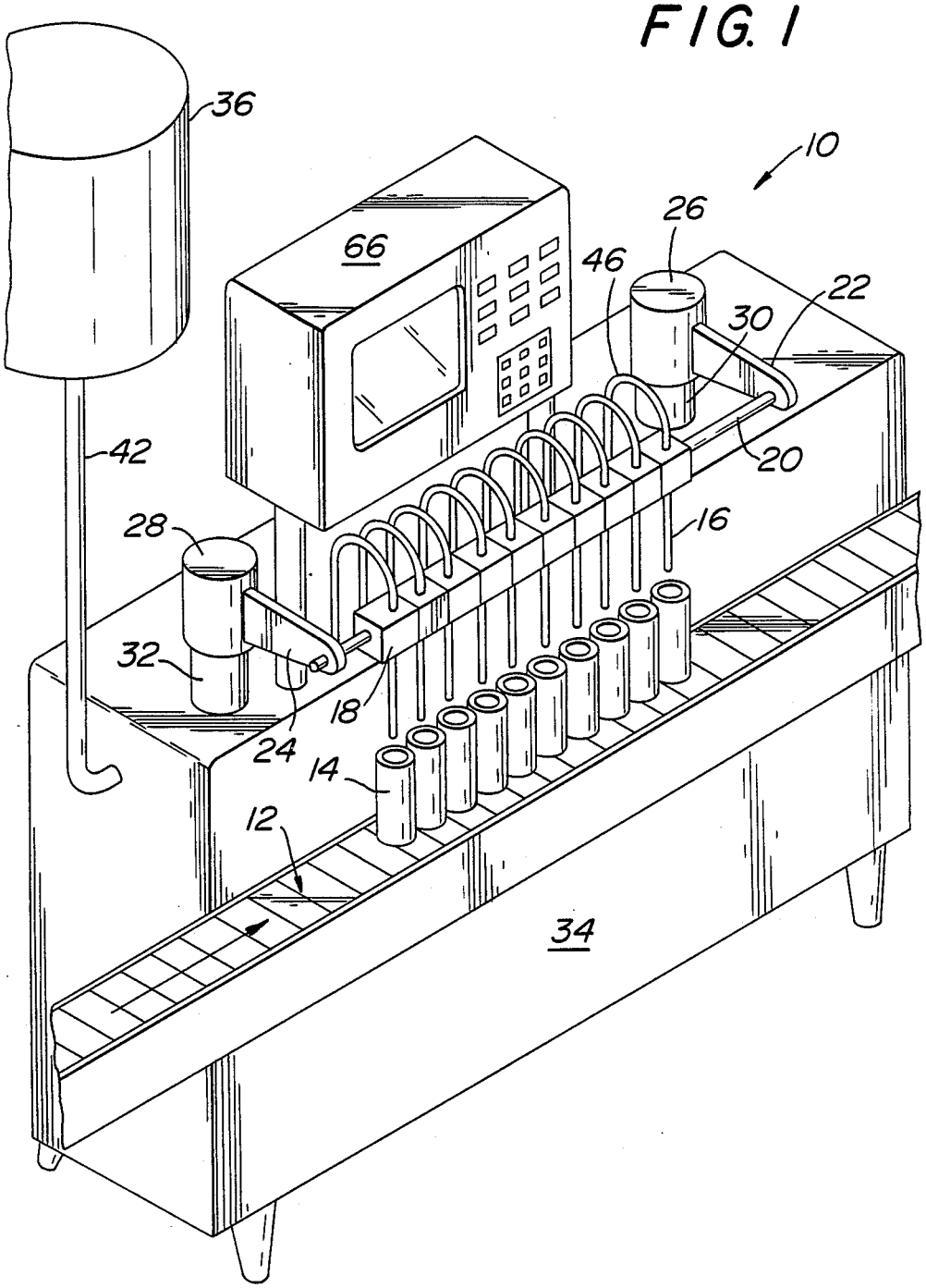
FIG. 1 is a perspective view of a machine in accordance with the present invention.

Referring to the drawings in detail, wherein like numerals indicate like elements, there is shown in FIG. 1 a machine in accordance with the present invention designated generally as 10. A discrete intermittently operated conveyor 12 is shown juxtaposed to the machine 10. The conveyor 2 supports a row of containers 14 which are adapted to be simultaneously filled.

The machine 10 includes a row of nozzles 16. Each nozzle 16 depends from and is releasably supported by a discrete support block 18. The blocks 18 are coupled together in any convenient manner such as by rod 20. The ends of rod 20 are supported by brackets 22, 24 which extend from cylinder heads 26, 28, respectively. Head 26 is guided for vertical movement by guide 30. Head 28 is guided for vertical movement by guide 32. The heads 26 and 28 are adapted for vertical movement by means of a power cylinder (not shown) so that the nozzle 16 may move into the containers 14 and then retract vertically upwardly so as to bottom fill the containers 14 when desired. It is desired to bottom fill containers 14 when the liquid being introduced into the containers 14 has a tendency to splash or foam.

The machine 10 includes a housing 34. A non-pressurized holding tank 36 is supported in any convenient manner at an elevation above the elevation of housing 34 so as to provide a pressure head of at least 5 feet. The holding tank 36 is provided with an inlet conduit 38 for filling the tank. See FIG. 2. At its upper end, the tank 36 may be provided with a sanitary vent 40. At its lower end, the tank 36 is provided with a flexible conduit 42 which interconnects the tank with a horizontally disposed manifold 44 located within the housing 34. The flexible conduit 42, and all other flexible conduits to be described hereinafter, are preferably made from an inert material which is suitable for use in connection with food and pharmaceuticals. One such material which may be used for conduit 42 is sold under the trademark "TYGON".

Figure 2:
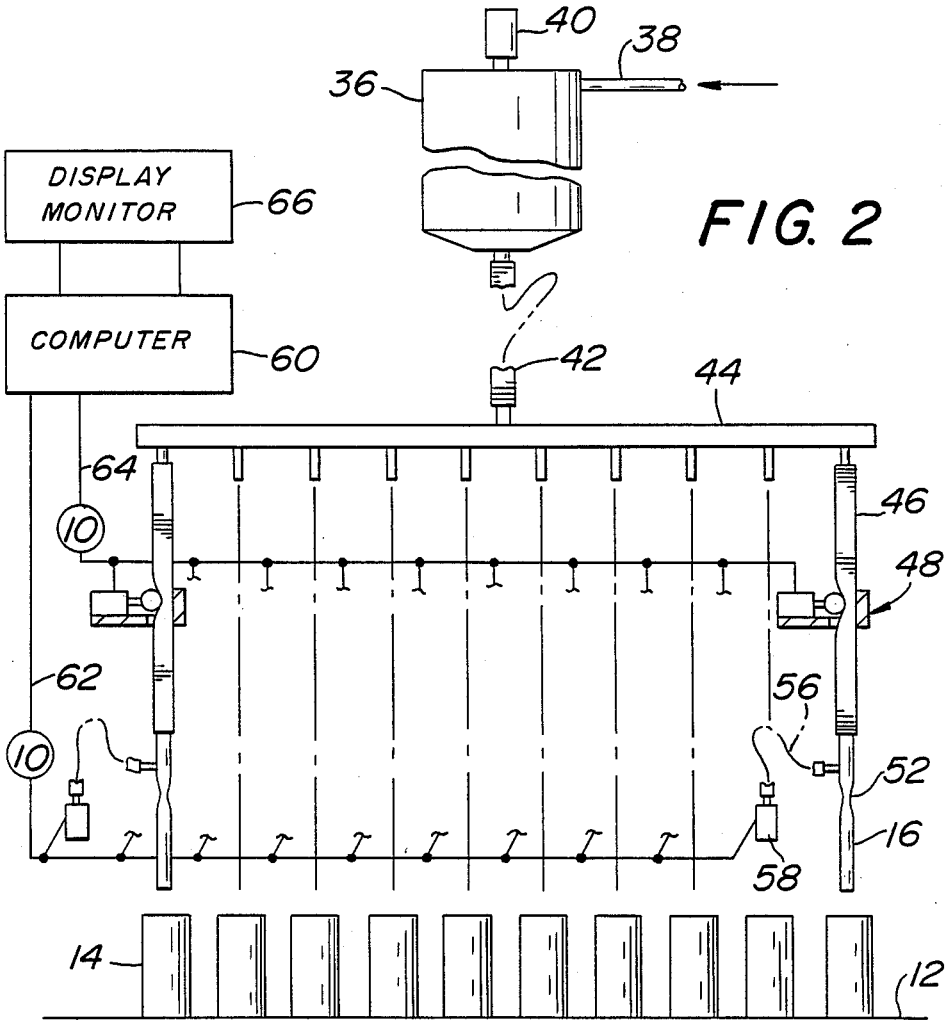
FIG. 2 is a diagrammatic illustration of the system of the present invention.
Figure 3:
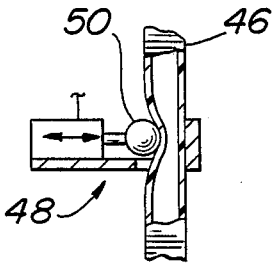
FIG. 3 is an enlarged sectional view of a flow control valve.

As shown in FIGS. 1 and 2, each nozzle 16 is connected to the manifold 44 by way of a flexible hose 46. Each flexible hose 46 is provided with a solenoid operated valve 48 having a valve member 50. See FIG. 3. Each valve member 50 is adapted to collapse its associated flexible hose 46 whereby flow will be controlled without any moving parts being in contact with the liquid being dispensed.

Figure 4:
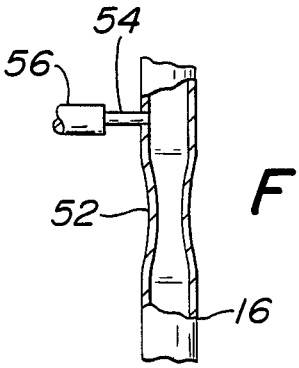
FIG. 4 is an enlarged sectional view of the restriction in the nozzles.

As shown more clearly in FIGS. 2 and 4, each nozzle 16 has a restriction 52. Restriction 52 is preferably a Venturi restriction with a tap 54 connected to the nozzle 16 upstream from the restriction. Each tap 54 is connected by way of a flexible hose 56 to a discrete pressure transducer 58. Each pressure transducer 58 generates a digital pressure signal which is separately coupled to a programmed computer 60 and represented in FIG. 2 by way of the line 62. The computer 60 is separately coupled to each of the solenoids of each of the valves 48 and represented in FIG. 2 by the line 64. Computer 60 is coupled to a display monitor 66. The monitor 66 is preferably mounted on top of the housing 34 as shown in FIG. 1. Computer 60 may be any commercially available programmable means such as a Texas Instruments Computer Model 9900.

As a result of the elimination of pressurized holding tanks and pumping motors, a minimum of information is required by the computer 60 whereby the computer program is relatively simple. As described more fully below, the following information is initially required by the computer 60: fill size of the containers 14 (ounces, gallons or millimeters), height of the containers 14 (inches), and number of containers 14 to be simultaneously filled. The computer continuously monitors the differential pressure across the restriction 52 at each nozzle 16 and calculates the proper fill time, namely the time during which each of the valves 48 must remain open to fill the associated container to the desired volume.

The computer calculation is based on the simple formula of $Q=C\sqrt{h}$ wherein Q is flow in gallons per minute, C is the orifice constant (orifice coefficient multiplied by orifice diameter squared) and the variable h is the pressure head in feed at the orifice. It can be shown that flow in oz./sec. equals $2.13\ C\sqrt{h}$. The pressure head h is directly related by a constant multiplier to the differential pressure across the restriction 52 as sensed by transducer 58. The program loop time (microseconds) during which a calculation is completed is a known parameter. The liquid volume (oz.) per loop$=2.13\ C\sqrt{h}$ multiplied by the program loop time. Since the total volume V of liquid (oz.) to be introduced into each container is known, the number of loops, and therefore the fill time in seconds for each nozzle is easily calculated. Thus, the number of loops$=V/[2.13\ C\sqrt{h}\times$loop time] and the fill time is $V/[2.13\ C\sqrt{h}]$. Alternatively, the computer can continuously calculate the volume of liquid discharged by each nozzle. When a threshold value representative of desired volume is reached, the computer separately closes each valve 48.

Accuracy of fill is a function of pressure transducer repeatability, resolution of the analog to digital conversion of the differential pressure signal, resolution of the computer program loop time, and the response time for shutting off the valves 48. The loop time can be as small as 0.0001 seconds. The present invention repetitively monitors differential pressure at each nozzle, and repeatedly calculates a number representative of fill time for each nozzle based on the pressure readings to simultaneously and accurately fill containers regardless of changes in the pressure head of 25% or more. The closed loop between the individual nozzles and the computer enable the computer to initially calculate fill time for a new container based on the fill time last calculated for the previous container. This feature has the advantage of taking into consideration the changes in the head of liquid in the holding tank 36 and variations in any nozzle due to clogging of the same.

In operation, the program first determines whether the cylinder heads 26, 28 are up or down. If the heads are down, the computer actuates the solenoid operated valves 48 to open the valve members 50, permitting liquid to flow through the nozzles 16 into containers 14. The program then enters a loop wherein, for each nozzle, the fill time or total number of loops required to obtain a fill volume V (which may vary from nozzle to nozzle) is calculated based on the differential pressure reading at the nozzle. In each loop, the differential pressure reading for all nozzles are temporarily stored in memory. The computer repeatedly traverses the loop until all valve members 50 have been closed as described more fully hereafter.

The computer maintains a count of the number of loops executed for each nozzle and during each loop compares this number of the value of the total number of loops required to fill the nozzle to the volume V as computed in the previous loop. When, for any nozzle, the count of the number of loops executed equals the value of the total number of loops required to obtain the fill volume V as calculated in the prior loop, the computer actuates the associated solenoid operated valve 48 to close valve member 50 and prevent filling of the container 14 beyond the volume V.

When all valve members 50 have been closed, the cylinder heads 26, 28 are raised and the last stored differential pressure readings for all nozzles are employed in calculating the value of the total number of loops required to fill the associated container to the new desired volume V.

The nozzle 16 and the manifold 44 are preferably made from stainless steel and are supported in a manner whereby they may be easily dismounted for sterilization. The other components which come into contact with the liquid are the flexible conduit 42, and the flexible hoses 46, 56 which may be removed and thrown away at periodic intervals. Holding tank 36 is easily flushed for cleaning and sanitation. Thus, down time with respect to cleaning and sanitizing the machine is minimal.

The size of orifice 52 will vary with the size of the containers being filled. When the containers 14 are 3 ounce containers, a preferred diameter for orifice 52 is 0.16 inch. Pressure vessels must comply with minimum requirements of various codes. Since the holding tank 36 is not a pressurized vessel, it does not have to be made from stainless steel, may have thinner walls, and thereby is substantially less expensive.

The present invention may be embodied in other specific forms without departing from the spirit or essential attributes thereof and, accordingly, reference should be made to the appended claims, rather than to the foregoing specification, as indicating the scope of the invention.

I claim:

1. A container filling machine comprising a liquid holding tank connected to a distribution manifold therebelow so that liquid may flow from said tank to said manifold by gravity, a plurality of discharge nozzles for simultaneously filling a plurality of containers, each nozzle being connected to said manifold by a discrete flexible hose, each nozzle having a restriction, a discrete means for sensing pressure in each nozzle upstream from its restriction for generating a pressure signal, a discrete valve for controlling flow through each flexible hose, and a programmable means separately connected to the pressure sensing means and valve associated with each nozzle for repetitively monitoring said pressure signal and calculating a number based thereon indicative of the fill time required to fill the associated container with a preselected volume of liquid, said programmable means being operative for counting counts which are collectively indicative of the actual time that has elapsed from the onset of the flow of the liquid into the containers, for comparing the number of counts with said fill time number, and for closing each valve for each nozzle when said number of counts equals said fill time number.

2. A machine in accordance with claim 1 wherein each sensing means includes a flexible hose connected at one end to a pressure transducer and at its other end to its associated nozzle.

3. A machine in accordance with claim 2 wherein each flexible hose is removable and disposable whereby only the nozzles and manifold require sanitizing.

4. A machine in accordance with claim 1 wherein each nozzle restriction is a venturi restriction.

5. A machine in accordance with claim 1 wherein each valve is a solenoid operated pinch valve for pinching its associated flexible hose for thereby controlling flow without contact between any portion of the valve and the liquid being controlled.

6. A machine in accordance with claim 1 wherein said programmable means calculates a number indicative of fill time for each container in terms of numbers of program loops, each program loop having a known loop time.

7. A container filling machine comprising means for holding liquid, a plurality of discharge nozzles for simultaneously filling a plurality of containers, each nozzle being connected to said liquid holding means by a discrete flexible hose, each nozzle havin a discharge outlet, means for sensing pressure in the nozzles upstream from their discharge outlets for generating a pressure signal, valve means for controlling flow through the flexible hoses, and a programmable computer having a stored program and operatively connected to the pressure sensing means and the valve means, for repetitively monitoring said pressure signal and automatically calculating in accordance with the stored program a fill time number derived from said pressure signal, said fill time number being indicative of the fill time required to fill the associated container with a preselected volume of liquid, said computer further having means for counting count numbers which are collectively indicative of the actual time that has elapsed from the onset of the flow of the liquid into the containers, means for comparing the counted count numbers with the fill time number, and means for closing the valve means for the nozzles when the counted count numbers equal said fill time number.

8. A machine in accordance with claim 7 wherein said programmable computer calculates said fill time number indicative of fill time for each container in terms of numbers of program loops, each program loop having a known loop time.

9. A machine in accordance with claim 7 wherein said programmable computer calculates said fill time number indicative of fill time for each container in terms of the flow of the liquid, the dimensions of the nozzles, and the pressure head of the liquid in the nozzles.

10. A machine in accordance with claim 7 wherein said pressure sensing means generates a digital pressure signal, and wherein said programmable computer is a digital computer.

* * * * *